United States Patent [19]

Gelhard

[11] 4,269,440

[45] May 26, 1981

[54] ELECTRICALLY ENERGIZED OPERATING MECHANISM FOR THE DOOR OF A VEHICLE AND THE LIKE, AND DRIVE ARRANGEMENT FOR THE MECHANISM

[75] Inventor: Egon Gelhard, Cologne, Fed. Rep. of Germany

[73] Assignee: Fichtel & Sachs AG, Schweinfurt, Fed. Rep. of Germany

[21] Appl. No.: 56,519

[22] Filed: Jul. 11, 1979

Related U.S. Application Data

[63] Continuation of Ser. No. 865,939, Dec. 30, 1977, abandoned, which is a continuation-in-part of Ser. No. 739,818, Nov. 8, 1975, abandoned.

[51] Int. Cl.[3] ..... E05C 13/04

[52] U.S. Cl. ..... 292/336.3; 292/201

[58] Field of Search ..... 292/1, 201, 144, 336.3, 292/340

[56] References Cited

U.S. PATENT DOCUMENTS

| | | | |
|---|---|---|---|
| 2,512,776 | 6/1950 | Queen | 292/144 |
| 2,606,052 | 8/1952 | Soreng et al. | 292/144 |
| 2,765,647 | 10/1956 | Carroll | 70/264 |
| 2,898,138 | 8/1959 | Van Noord | 292/122 |
| 3,241,870 | 3/1966 | Cairelli | 292/144 |
| 3,354,583 | 11/1967 | Moorman et al. | 292/201 X |
| 3,541,874 | 11/1970 | Du Rocher | 74/424.8 |
| 3,566,703 | 3/1971 | Van Noord | 292/201 X |
| 3,710,632 | 1/1973 | Tucker | 74/89.15 |

FOREIGN PATENT DOCUMENTS 2206765 6/1974 France .

*Primary Examiner*—Richard E. Moore

*Attorney, Agent, or Firm*—Toren, McGeady and Stanger

[57] ABSTRACT

A drive arrangement including a flywheel, an electric motor drivingly connected to the flywheel for rotating the same is provided with a motion transmitting train operatively interposed between the flywheel and an output member of the drive arrangement for transmitting motion from the flywheel to the output member only after a certain number of revolutions of the flywheel about its axis, thereby permitting the flywheel to be accelerated under no-load conditions before the energy stored therein is transmitted to the output member and to a load connected to the same. Because energy can be supplied by the drive arrangement at a much higher rate than would be available from the electric motor, the drive arrangement is well suited for door operating units of a motorcar and the like which need to be installed in the limited space within the door.

32 Claims, 11 Drawing Figures

20
19
18
17
13
21
12
9
8
11
10
7
6
1
22
2
3
16
4
5
15
14

19
20
18
17
13
21
12
9
11
7
8
10
4
31
22
29
3
16
30
2
15
14
1

ELECTRICALLY ENERGIZED OPERATING MECHANISM FOR THE DOOR OF A VEHICLE AND THE LIKE, AND DRIVE ARRANGEMENT FOR THE MECHANISM

This is a continuation of application Ser. No. 865,939 filed Dec. 30, 1977, now abandoned, which in turn is a continuation-in-part application of Ser. No. 739,818 filed Nov. 8, 1975, now abandoned.

This invention relates to a drive arrangement including an electric motor and a flywheel and capable of supplying energy at a rate not available from the motor alone, and to a car operating mechanism employing such a drive arrangement.

It is known from U.S. Pat. No. 2,898,138 to operate a door automatically by means of electric power, and motor vehicles with electrically operated door locks are staple articles of commerce.

The known door operating mechanisms require relatively bulky motors and other devices which are not readily accommodated within the limited space available in a hollow door and find even less space elsewhere in the vehicle body.

A primary object of this invention is the provision of a drive arrangement suitable for a door operating mechanism which is small enough to fit within a hollow vehicle door, yet powerful enough for operating a locking mechanism or a door closing mechanism.

Another object is the provision of a door operating mechanism for locking or closing a door which includes the afore-mentioned drive arrangement.

With these objects and others in view, as will hereinafter become apparent, the invention, in one of its more specific aspects, provides a drive arrangement in which an inertial mass, such as a flywheel, is mounted for rotation about an axis. An electric motor is drivingly connected to the mass for rotating the same. A motion transmitting train is operatively interposed between the mass and an output member of the drive arrangement and includes a delay device for transmitting motion from the rotating mass to the output member in response to a predetermined number of revolutions of the mass about its axis.

In another aspect, the invention provides an improvement in a vehicle which has a cover member, such as a door, secured to the vehicle body for movement toward and away from a position in which the cover member closes an opening in the body, and a mechanism or mechanisms for moving the cover member toward the closing position and for securing it in this position, an operating element being movably mounted on the vehicle and operatively connected to the cover member. According to the invention, the flywheel of the afore-described driving arrangement is coupled to the operating element as the output member of the drive arrangement so that the element is moved in response to rotation of the flywheel, and such motion transmission is delayed after the energizing of the electric motor for a period sufficient to permit acceleration of the flywheel by the driving electric motor to a predetermined angular velocity.

Other features, additional objects, and many of the attendant advantages of this invention will readily be appreciated as the same becomes better understood from the following detailed description of preferred embodiments when considered in connection with the appended drawing in which.

Figure 1:
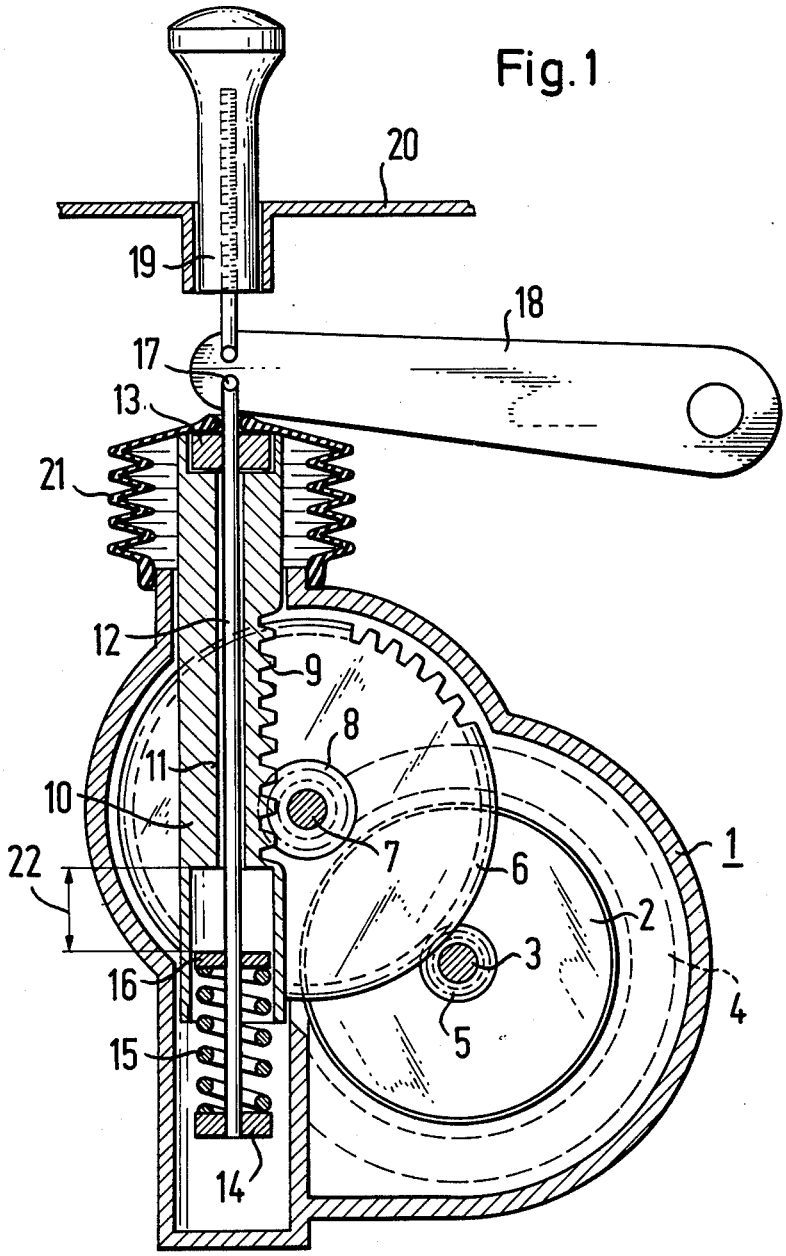
FIG. 1 shows a door of a motorcar equipped with a locking mechanism operated by a drive arrangement of the invention in fragmentary, side-elevational section.
Figure 2:
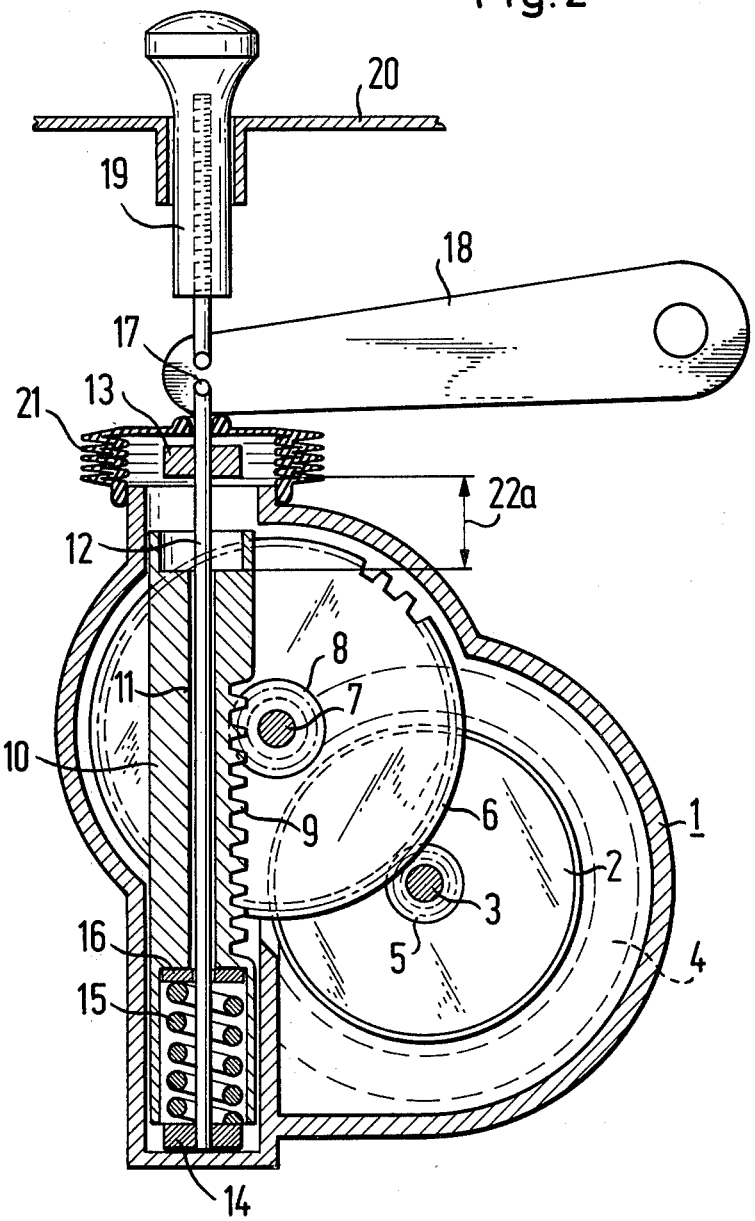
FIG. 2 illustrates the apparatus of FIG. 1 in a different operative position.

Referring initially to FIGS. 1 and 2, there is shown a locking mechanism for a motorcar door whose drive arrangement is enclosed in a housing 1. The stator of a conventional, reversible, electric motor 2 is fixedly attached to the door structure by the housing 1. Only the output shaft 3 of the rotor is seen in FIG. 1. One end of the shaft 3, not itself seen in FIG. 1, passes outward of the housing 1 and carries a flywheel 4. A pinion 5 on the other end of the shaft 3 meshes with a larger spur gear 6 on a transmission shaft 7 which is journaled in the housing 1 and also carries another pinion 8. The pinion 8 engages teeth 9 of a rack 10 vertically guided in the housing 1.

A vertical bore 11 in the rack 10 slidably receives a rod 12 which carries fixed collars 13,14 near its two ends outside the bore 11. In the position of the rod 12 shown in FIG. 1, the collar 13 abuts from above against a transverse face of the rack 10. A helical compression spring 15 attached to the collar 14 is coiled about the lower end of the rod 12 and carries an annular stop 16.

The rectangularly offset top end 17 of the rod 12 is hooked into the free end of an operating arm 18 for a door lock, conventional and not otherwise shown, which may also be opened and closed conventionally by means of a knob 19 guided in the frame 20 of the door. The stem of the knob 19 is hooked into the arm 18, and the arm is journaled in the door frame 20 in a manner well known by itself and not explicitly illustrated. Bellows 21 attached to the housing 1 and the rack 10 protect the contents of the housing 1 against contaminants. In the position of the mechanism illustrated in FIG. 1, a gap 22 separates the stop 16 from an opposite, transverse abutment face of the rack 10.

When the motor 2 is energized to rotate the shaft 3 clockwise, the rack 10 is lowered from the position of FIG. 1, but the rod 12 and arm 18 stand still until the stop 16 is engaged by the opposite face of the rack 10. During further downward movement of the rack 10, the rod 12 pulls the knob 19 down and correspondingly pivots the arm 18 counter-clockwise until the position shown in FIG. 2 is reached in which the gap 22 has disappeared, and a corresponding gap 22*a* has opened between the fixed stop 13 and the associated abutment face of the rack 10. When the motor 2 is energized in the position of FIG. 2 to rotate the shaft 3 counterclockwise, the rising rack 10 premits expansion of the spring 15 which was compressed slightly for braking the down stroke of the rack 10, but the rod 12 stands still until the gap 22*a* is consumed. As is evident from the showing of the knob 19, the locking mechanism represented in the drawing by the arm 20 only locks the door represented by the frame 20 in the position of FIG. 2 and unlocks the door in the position of FIG. 1 so that it may be opened by depressing a handle or the like.

The rack 10 and rod 12 constitute a lost-motion linkage in the motion transmitting train which operatively connects the motor 2 to the arm 18. While the rack 10 moves through the gaps 22, 22*a*, the only significant load on the motor 2 is the inertial mass of the initially stationary flywheel 4 whose momentum is much greater than that of the rotor including the shaft 3 and of the associated transmission elements 5, 6, 7, 8 even when combined with the weight of the rack 10. The energy of the motor 2 thus is applied initially almost exclusively to accelerating the flywheel 4. The energy stored in the flywheel is available later for shifting the locking mechanism between the positions of FIGS. 1 and 2. The motor 2 itself may be chosen much smaller than would be needed for operating the arm 18 through the reducing gear transmission 5, 6, 8, 9 in the absence of the flywheel and the lost motion linkage, and the reduced size of the motor is of great advantage in the limited space available for it between the outer and inner walls of a hollow motorcar door.

The amount of energy stored in a flywheel of a given mass rotating about an axis through its center of gravity depends on the velocity of the flywheel at the moment when energy is first withdrawn from the wheel for moving the load of the arm 18. Again for reasons of limited space, it is desirable that the flywheel be as small as possible. A good compromise between the several design parameters involved is generally achieved if the flywheel 4 is accelerated to a spped of at least 1500 r.p.m. from its initial standstill before the stop 16 or the collor 13 abuts against the rack 10. Expressed otherwise, the delay with which motion is transmitted from the motor 2 to the arm 18 is a unique function of the number of revolutions of the flywheel 4 from standstill to its maximum velocity.

Figure 4:
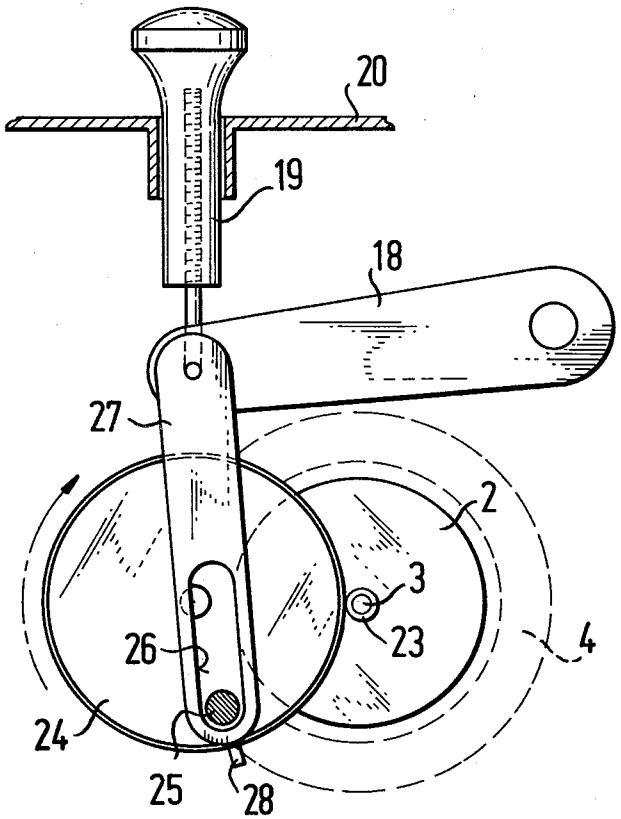
FIGS. 3 and 4 are respective views, corresponding to those of FIGS. 1 and 2, of a door equipped with a modified drive arrangement.
Figure 3:
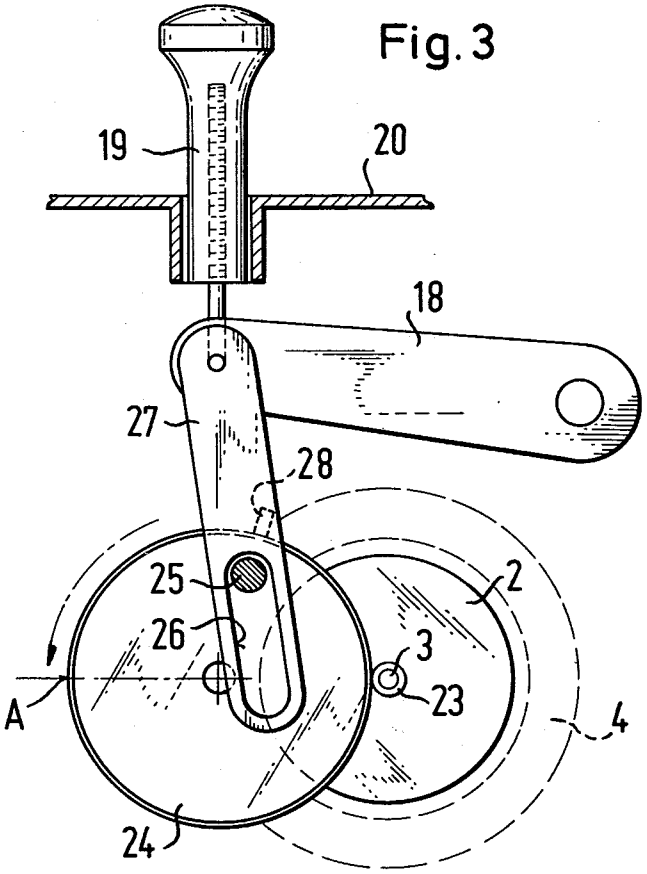

Many variations of the motion transmitting chain of FIGS. 1 and 2 will readily come to mind, and particular simple modification is illustrated in FIGS. 3 and 4 which show a motor 2, its output shaft 3, a flyweight 4, and operating arm 18, knob 19 and door frame 20 not significantly different from the correspondingly numbered elements of the first-described arrangement.

A small friction wheel 23 on the motor shaft 3 engages a friction face of a much larger wheel 24. The necessary contact pressure is provided by the weight of the motor 2 and flywheel 4 which are mounted on a pendulum suspension not explicitly shown. An axial, eccentric crank pin 25 on the wheel 24 limits angular movement of the latter about an axis fixed relative to the door frame 20 to an angle of about 350° by engagement with a non-illustrated abutment on the door frame 20.

In the starting position of the wheel 24 corresponding to the open condition of the door, the pin 25 is offset approximately 70° clockwise from the position shown in FIG. 3. During initial movement into the illustrated position, the pin 25 slides idly upward in the slot 26 and further moves idly downward through a counterclockwise arc of approximately 100° from the position of FIG. 3 before it pulls the bar 27, the knob 19, and the arm 18 toward their locking positions illustrated in FIG. 4. The actual working stroke of the pin 25 is limited to an arc of about 90°, beginning at angular position A, and the pin 25 thereafter moves idly into a position approximately 70° beyond the position of FIG. 4 in which the projection 28 engages the non-illustrated abutment. During the opening movement of the wheel 24, indicated in FIG. 4 by a clockwise arrow, energy of the motor 2 is stored in the flywheel 4 until the pin 25 again reaches an end of slot 26 near position A after an idle stroke of about 170°.

The spring 15 shown in FIG. 1 permits the automatically locked door to be opened manually by pulling the knob 19 and the attached rod 12 upward and thereby compressing the spring 15 without changing the position of the rack 10. As is evident from inspection of FIG. 3, the knob 19 may also be pulled up from the position of FIG. 4 after the pin 25 reaches the end of its closing movement in a position approximately diametrically opposite position A.

Figure 5:
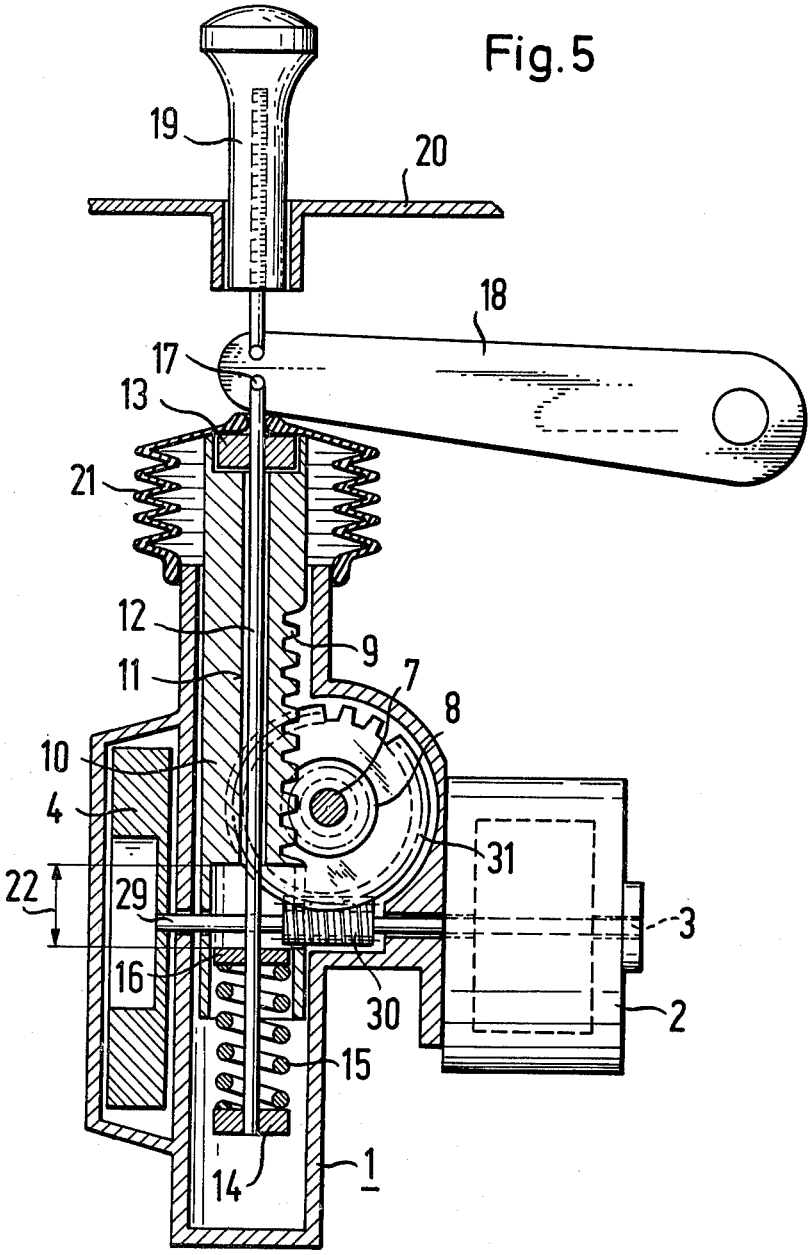
FIG. 5 shows a door equipped with yet another drive arrangement in the manner of FIGS. 1 and 3.

The door locking mechansim illustrated in FIG. 5 differs from that described above with reference to FIG. 1 mainly by a different orientation of the motor 2, the shaft 3, and the flywheel 4, and by the speed-reducing gear transmission which connects the rack 10 to the shaft 3, but includes a pinion 8 mounted on a shaft 7 and a meshing with the rack 10 in the manner described in more detail with reference to FIG. 1. A worm 30 on the shaft 3 meshes with a wormwheel 31 on the shaft 7. The free end 29 of the shaft 3 is attached to the flywheel 4 by a shrink fit. The arrangement illustrated in FIG. 5 requires more space at right angles to the plane of the drawing than the afore-described drive mechanisms, but is preferred for use with heavy and relatively thick doors, such as those of a bus.

Figure 6:
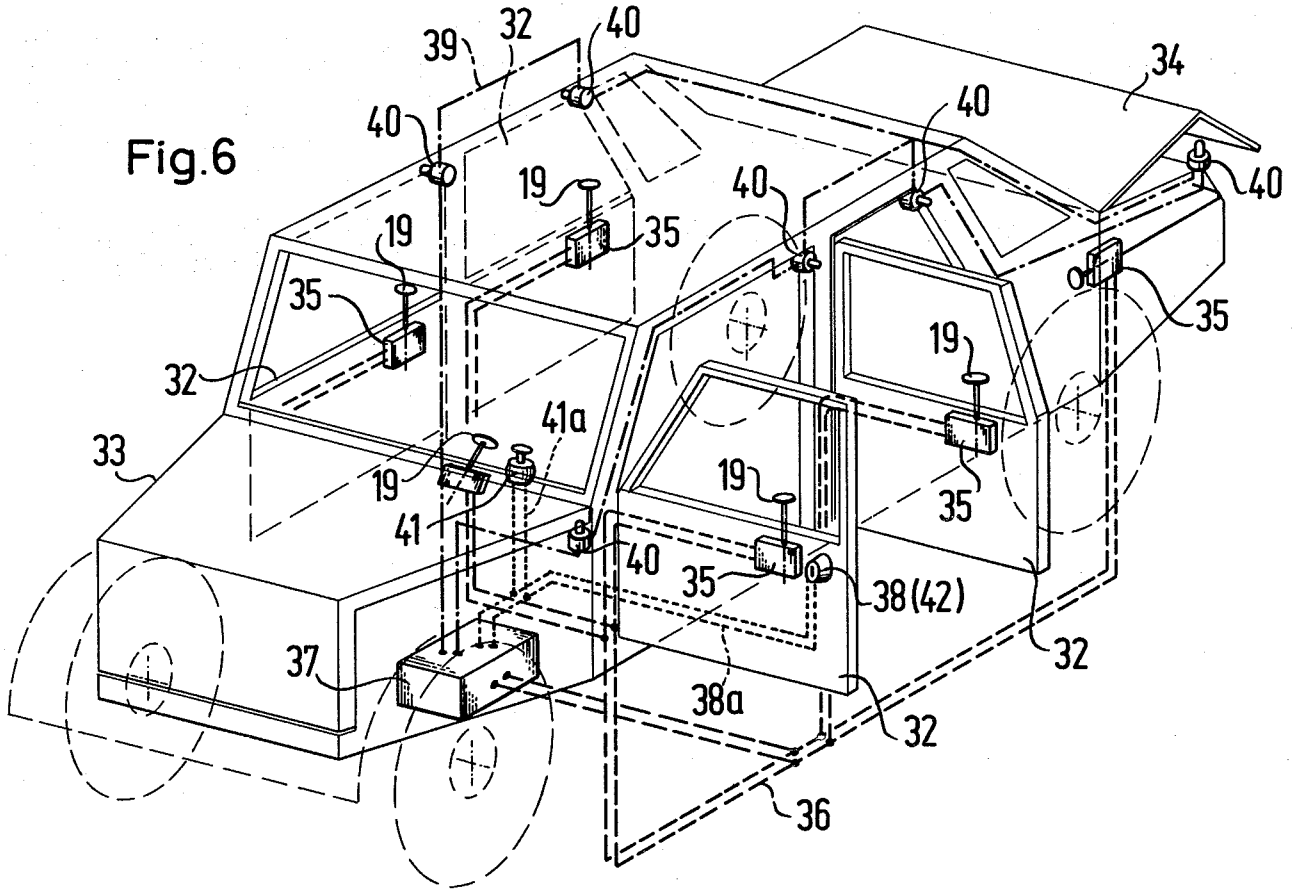
FIG. 6 illustrates an electrical locking arrangement according to the invention in a motorcar shown in perspective phantom view.

A door locking system employing locking mechanisms of the general type described above with reference to FIGS. 1 to 5 is shown in FIG. 6 as applied to a sedan having four doors 32, a hood 33, and a trunk lid 34. Locking units 35 accessible from the passenger compartment of the car and provided with knobs 19 are mounted on each of the four doors and additionally near the windshield and rear window for locking the hood 33 and trunk lid 34 respectively. They may be energized through two-strand cables 36 from a control 37 to be described in more detail with reference to FIG. 7. A switch 38 in the lock of the door near the driver's seat is connected with the unit 27 by a dual-strand cable 38*a*. Normally open switches 40 on the car body at each of the six hingedly mounted covers, that is, the doors 32, the hood 33, and the trunk lid 34, are connected in series circuit with each other and the unit 37 by an insulated conductor 39 to close the circuit when all covers are shut, and thereby to permit operation of the locking units 35. A switch 41 within reach of the driver and connected to the unit 37 by a line 41*a* also permits locking of all doors to be initiated.

Figure 7:
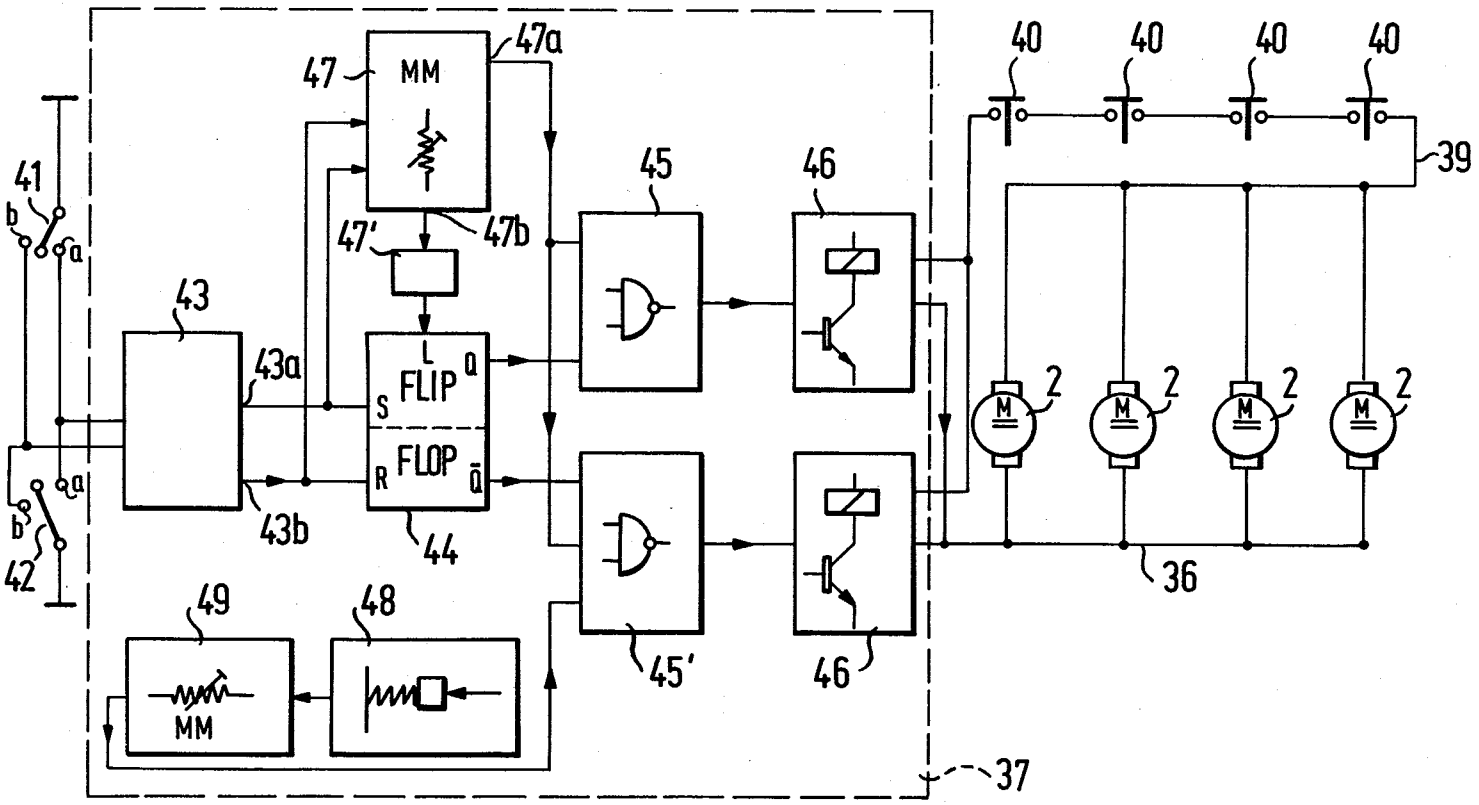
FIG. 7 is a circuit diagram of portions of the locking arrangement of FIG. 6.

Elements shown in FIG. 6 are again illustrated in FIG. 7 together with the circuitry of the control unit 37, and elements of FIG. 6 not specifically illustrated in FIG. 7 duplicate structure shown. Thus, only four motors 2 of corresponding locking mechanisms 35 are seen in FIG. 7 with their common energizing conductors 36, and only four of the switches 40 series-connected by a conductor 39. The switch 41 is a single-pole double-throw switch including stationary contacts, a, b connected to corresponding contacts of the switch 38 whose movable contact 42 is grounded to the car body, as is the movable contact of the switch 41. The contact 42 is moved by a key inserted in the lock of the associated door as is known in itself or by the door knob.

A conventional signal converter circuit 43, not shown in detail, prevents chatter of the switch contacts 41, 42 from unfavorably affecting the remainder of the circuit. When one of the switch contacts 41, 42 is shifted, chatter-free signals are provided from outlet terminals 43*a*, 43*b* of the circuit 43 to input terminals R, S of a flip-flop circuit 44 which may also be replaced by any other bi-stable device, such as a relay. The terminals 43*a*, 43*b* are also connected to a timing circuit 47 including a monostable multivibrator 47 whose output terminals 47*a*, 47*b* release a signal of fixed, adjustable duration when one of the movable contacts 41, 42 is switched. An additional timer 47' connects the output terminal 47*b* with the L input of the flip flop circuit 44. In the absence of a timing signal at input L, the flip flop circuit may not be switched from one condition to the other.

The output terminal 47*a* is connected to respective input terminals of two gate circuits 45, 45'. Second input terminals of the gate circuits are connected to the Q, $\overline{Q}$ output terminals of the flip flop circuit 44. The gate circuit 45' has a third input terminal connected to a supplemental timing and delay device 49 including an adjustable monostable multivibrator.

The output signals of the gate circuits 45, 45' are fed to respective amplifiers 46 which each include a transistor connected to a relay. The energizing circuit of the motors 2 in series with the switches 40 is connected to the output terminals of each of the two amplifiers 46.

The circuitry illustrated in FIG. 7 operates as follows:

When the driver's door is locked, the movable contact 42 of the switch 38 engages the associated stationary contact a, an output signal is generated at terminal 43*a* and is transmitted to the flip flop circuit 44 and the timing circuit 47, causing a signal to appear at output terminal Q. As long as timing circuit 47' maintains a signal at flip flop input L, the flip flop circuit 44 cannot return to its initial stable condition even if the contact 41 is switched to contact b. As will presently be described, the condition of the flip flop circuit determines the direction of rotation of each motor 2, and the presence of a signal at input terminal L thus prevents reversal of current in the energized motors 2.

As long as signals simultaneously reach the AND or NAND gate circuit 45 from the output terminals 47*a* and Q, the gate circuit delivers a signal to the associated amplifier 46, and the relay in the amplifier connects the two poles of the battery of the car, not itself shown, with the conductors 36, 39 respectively. If all switches 40 are closed, the motors 2 are energized and accelerate the associated flywheels 4. When the timer 47 reaches the end of the period set, the current supply to the motors 2 is interrupted by the relay in the amplifier 46, but the blocking signal supplied by the timer 47' to the input terminal L persists somewhat longer to prevent reversal of current in the motors 2 as long as their output shafts 3 rotate with the flywheels. The energy stored in the flywheels is thus transmitted to the operating arms 18, and the flywheels are stopped before the motors may be energized to unlock the associated doors, hood, and trunk lid. The locking operation may be initiated by the manual switch 41 in a manner obvious from the preceding description. Such locking may be desired, for example, to guard against unauthorized entry of an outsider while the initially unlocked car stands still and all doors are closed.

To unlock the doors 32, hood 33, and lid 34, the knob 19 on the driver's door may be pulled up by hand, and the door opened thereafter. The resulting shifting of the contact 42 to the associated fixed contact b causes the flip flop circuit 44 to generate a signal at output $\overline{Q}$ and to energize the relay in the amplifier 46 associated with the gate circuit 45' for a period again determined by the timing circuit 47. The relay energizes the motors 2 to rotate in the direction necessary for moving the operating arm 18 from the position of FIGS. 2 or 4 into that of FIGS. 1 and 3.

The supplemental timing and delay device 49 is connected to an inertial responsive switch 48 which provides a starting signal to the monostable multivibrator in the timing device 49 when the switch 48 is accelerated at a rate corresponding to 8 to 10 times terrestrial gravity g, as may occur in a collision. The output signal of the timing circuit 49 is briefly delayed, and the gate circuit 45' is arranged in such a manner that it activates the associated amplifier 46 in response to the delayed signal and causes all doors to be unlocked to permit escape of the occupants from the vehicle after a brief delay which prevents opening of the doors and ejection of the occupants before the vehicle comes to rest after the impact.

As is evident from the described mode of operation, all locking units 35 are synchronized after every switching of the contacts 41, 42 if the units were previously unlocked or locked manually only in part.

The drive arrangements illustrated in FIGS. 1 to 5 and their equivalents may be employed to advantage for actuating devices other than the locking units specifically referred to and having similar power requirements particularly when coupled with little available space. An application closely related to that described with reference to FIGS. 1 to 7 is shown in FIGS. 8 to 11 which illustrate a door closing mechanism in different operative positions.

Figure 8:
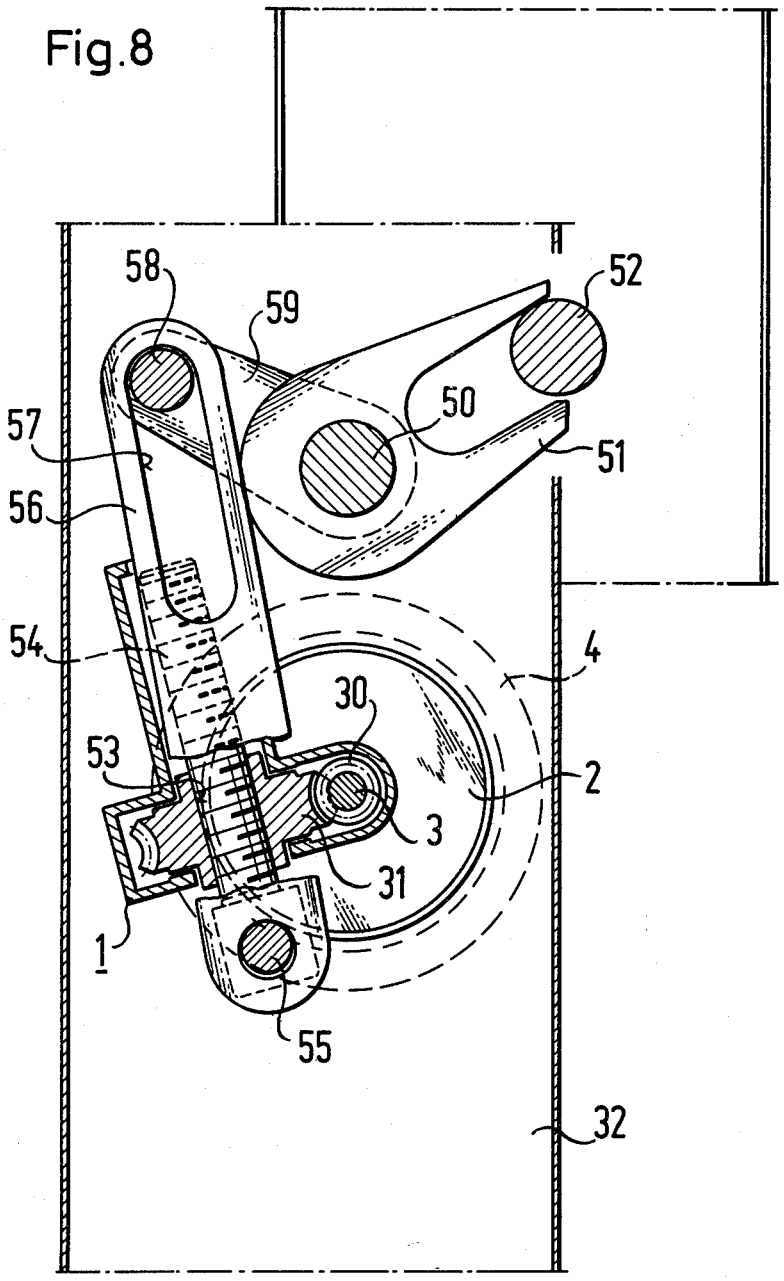
FIG. 8 is a fragmentary view of a motorcar door in sectional side elevation, the door being equipped with a door closing mechanism according to the invention.
Figure 9:
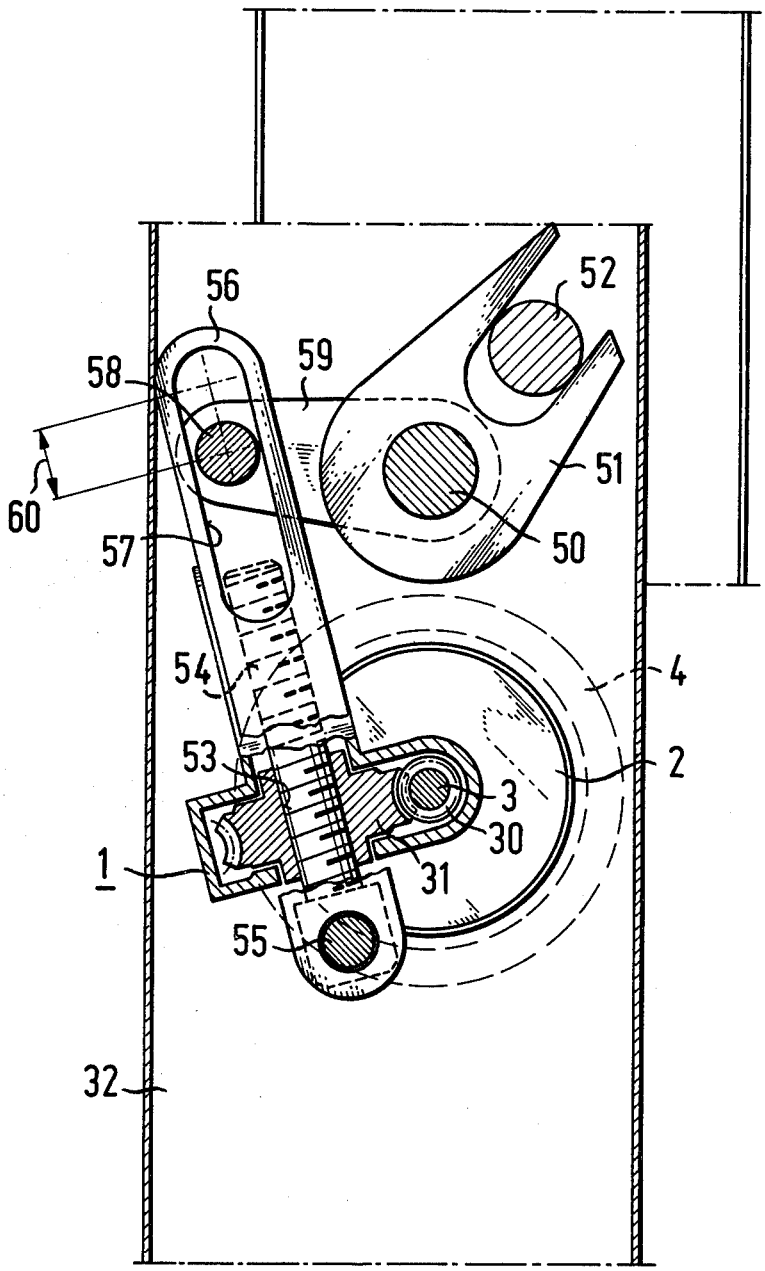
FIGS. 9, 10, and 11 show the door of FIG. 8 in different operative positions.

Referring initially to FIG. 8, there is seen a door 32 in which a fork 51 is mounted on a pivot shaft 50 for engaging a pin 52 on the door frame, not otherwise illustrated in detail. When the door 32, while being closed manually, passes through the position shown in FIG. 8, contacts in an associated switch analogous to the switches 40 shown in FIG. 6 are closed and energize an automatic closing mechanism including an electric motor 2, a flywheel 4 mounted on the output shaft 3 of the motor 2, and a housing 1 fixedly mounted on the door 32 in a manner not explicitly shown. The motor, output shaft, and flywheel cooperate in a manner obvious from the above description of locking units to rotate a worm 30 on the shaft 3 and thereby to turn a worm wheel 31 mounted on threads 53 of a spindle 54, the worm wheel being secured axially by the housing 1. One end of the spindle 54 projects from the housing 1 in all operative positions of the spindle. A pivot pin 55 on the projecting spindle end couples the spindle 54 to a bar 56 having a longitudinal slot 57. An arm 59 fixedly fastened to the fork 59 carries a pin 58 which is slidably received in the slot 57 and moves away from the closed top end of the slot 57 much faster than the motor 2 and spindle 54 can lower the bar 56 when the door moves beyond the position of FIG. 8. When the closing movement of the door is slowed by engagement of non-illustrated resilient sealing elements on the door and frame, the position of FIG. 9 is reached in which a gap 60 separates the pin 58 from the slot end. Manual pressure on the door 32 may now be relaxed. The flywheel 4 is accelerated as the practically only load on the motor 2 until the pin 58 reaches the end of its idle stroke in the slot 57 and is pulled down into the position of FIG. 10. The resulting counterclockwise movement of the fork 51 about the pin 52 causes the door to be fully shut and the non-illustrated sealing elements to be compressed.

Figure 10:
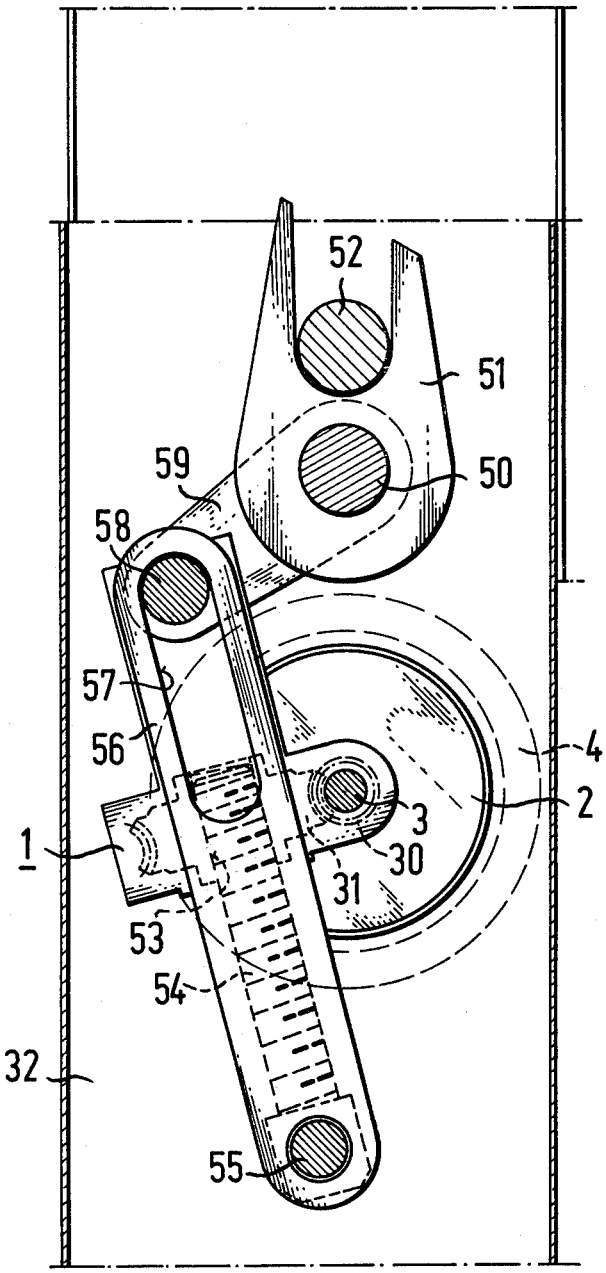
Figure 11:
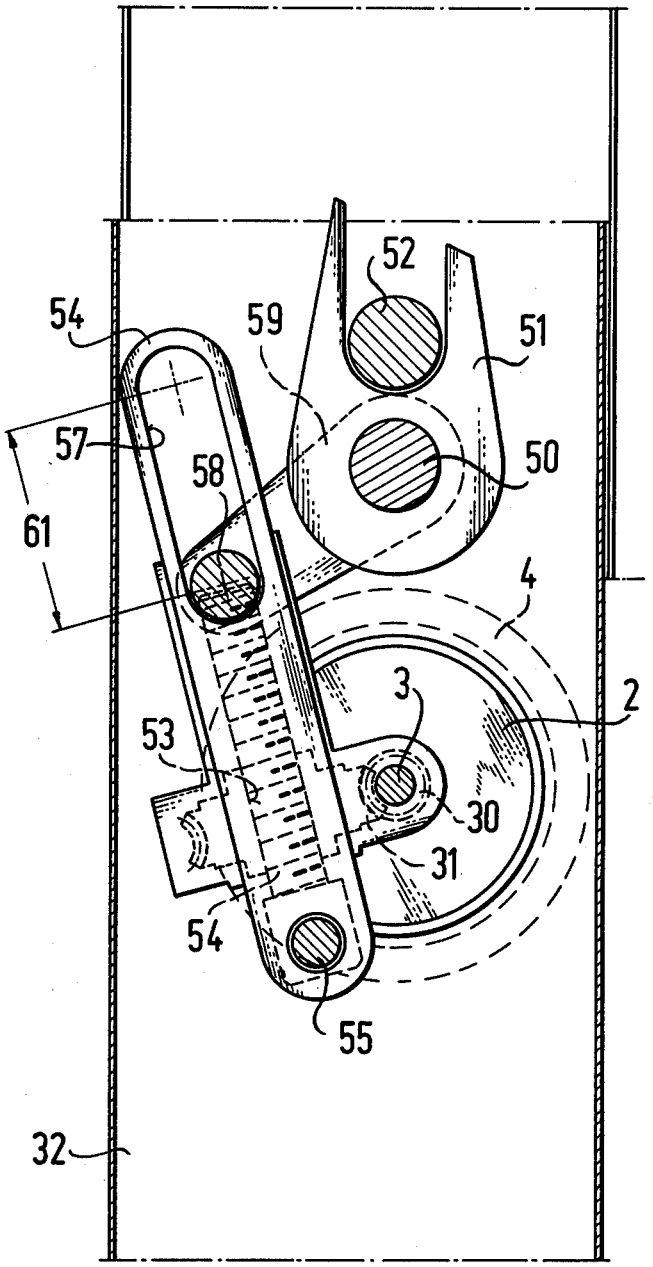

The non-illustrated switch on the door frame which is closed when the door reaches the position illustrated in FIG. 8 connects the battery of the car to the motor 2 through a timing circuit, not specifically shown but conventional in itself, which deenergizes the motor 2 before the position of FIG. 10 is reached, and thereafter energizes the motor briefly with reversed direction of rotation. The door closing mechanism comes to a halt in the position shown in FIG. 11 in which a gap 61 separates the pin 58 from the top end of the slot 57. When the door thereafter is opened manually, the bar 57 stands still while the pin 58 moves idly in the slot 57 to a position shown in FIG. 8.

If the door 32 is slammed shut, it passes through the condition of FIG. 8 too quickly for the door switch to start the motor 2. The pin 58 moves idly in the slot 57 from the position of FIG. 8 to that of FIG. 11.

The force required for fully closing a car door is of the order of 500 to 1000 Newtons (50 to 100 kg). The motor 2 operating the automatic door closing mechanism needs to provide only a small fraction of this force, and the door is closed by the energy stored in the flywheel 4 while the bar 57 is moved by the energized motor 2 from the position of FIG. 9 through the length of the gap 60.

In a door equipped with a locking mechanism as well as an automatic closing mechanism of the invention, two motors 2 and associated flywheels 4 need to be provided. However, additional elements of the control unit 37 may be employed for controlling, the door closing mechanism in the manner described.

It should be understood, of course, that the foregoing disclosure relates only to preferred embodiments, and that it is intended to cover all changes and modifications of the examples of the invention herein chosen for the purpose of the disclosure which do not constitute departures from the spirit and scope of the invention set forth in the appended claims.

What is claimed is:

1. A drive mechanism for driving an operating member comprising: drive means; energy storage means connected to receive energy from said drive means; an output member for transmitting energy from said drive mechanism to an operating member to be driven thereby; and transmission means for transmitting driving energy to said output member from both said drive means and said energy storage means; said transmission means being arranged to delay transmission of energy to said output member until said drive means has undergone a number of revolutions and to effect commencement of transmission of driving energy to said output member independently of the angular velocity of said drive means when said drive means has undergone said number of revolutions.

2. A drive mechanism comprising: drive means; energy storage means connected to receive energy from said drive means; an output member for transmitting energy from said drive mechanism; and transmission means for transmitting driving energy to said output member from both said drive means and said energy storage means, said transmission means being arranged to delay transmission of energy to said output member until said drive means has undergone a number of revolutions, during which delay said drive means operates to impart energy to said energy storage means for storage therein; said transmission means being also arranged to effect commencement of transmission of driving energy to said output member independently of the angular velocity of said drive means when said drive means has undergone said number of revolutions, the energy thus transmitted including energy previously stored in said energy storage means by said drive means.

3. A mechanism according to claim 1 wherein said operating member comprises a securing mechanism of a door lock system.

4. A mechanism according to claim 3 wherein said securing mechanism constitutes part of the closing mechanism of said door lock system.

5. A mechanism according to claims 1 or 2 wherein said drive means comprise electrical drive means.

6. A mechanism according to claim 5 wherein said electrical drive means comprise an electric motor.

7. A mechanism according to claims 1 or 2 wherein said transmission means comprise a lost motion device.

8. A mechanism according to claims 1 or 2 wherein said transmission means comprise a first transmission member connected to be driven by said drive means and a second transmission member connected to impart driving energy to said output member, said first and second transmission members being arranged to be brought into abutting relationship upon said commencement of transmission of driving energy to said output member.

9. A mechanism according to claim 8 wherein each of said first and said second transmission members are always maintained within the path of movement of the other.

10. A mechanism according to claims 1 or 2 wherein said transmission means comprise a speed reduction system.

11. A mechanism according to claim 10 wherein said speed reduction system comprises speed reduction gear means.

12. A mechanism according to claim 10 wherein said transmission means further comprise a lost motion device interposed between said drive means and said output member, said speed reduction system being interposed between said drive means and the drive means side of said lost motion device.

13. A mechanism according to claim 8 further comprising a speed reduction system interposed between said drive means and said first transmission member.

14. A mechanism according to claims 1 or 2 wherein said drive means comprise reversible drive means capable of providing driving energy in two reversed directions.

15. A mechanism according to claims 1 or 2 wherein said transmission means comprise first transmission means driven by said drive means and second transmission means in driving engagement with said output member, said first transmission means and said second transmission means being brought into abutting relationship upon said commencement of transmission of driving energy to said output member, said second transmission means comprising a pair of abutment members located on opposite sides of said first transmission means and located to be engaged by said first transmission means to drive said output member in opposite directions.

16. A mechanism according to claim 15 wherein said first transmission means includes a first and a second abutment surface located on opposite sides thereof and adapted to engage, respectively, said pair of abutment members of said second transmission means, said pair of abutment members of said second transmission means being located apart a greater distance than said pair of abutment surfaces of said first transmission means.

17. A mechanism according to claim 15 wherein said first transmission means is movable along a substantially linear path and wherein said abutment members of said second transmission means are located within said linear path on opposite sides of said first transmission means.

18. A drive mechanism comprising: drive means; energy storage means connected to receive energy from said drive means; an output member for transmitting energy from said drive mechanism; and transmission means for transmitting driving energy to said output member from both said drive means and said energy storage means, said transmission means being arranged to delay transmission of energy to said output member until said drive means has undergone a number of revolutions, during which delay said drive means operates to impart energy to said energy storage means for storage therein, said transmission means being also arranged to effect commencement of transmission of driving energy to said output member when said drive means has undergone said number of revolutions, the energy thus transmitted including energy previously stored in said energy storage means by said drive means, said transmission means comprising crank means driven by said drive means and a slotted transmission member interconnected between said crank means and said output member, said slotted transmission member having slot means formed therein within which said crank means are engaged, said slot means being arranged to permit relative movement between said crank means and said slotted transmission member without transmission of energy therebetween during a period of time commensurate with the period of time during which said delay of energy transmission occurs.

19. A mechanism according to claim 8 wherein said first transmission member comprises a crank member having an eccentric pin mounted therein and wherein said second transmission member comprises a slotted rod having an elongated slot defined therein, said elongated slot having a pair of terminal ends, with said eccentric pin being engaged within said slot to become engaged, respectively, with each of said terminal ends of said slot during rotation of said crank means.

20. A mechanism according to claims 1 or 2 wherein said transmission means comprise a rack member adapted to be driven by said drive means in either one of two opposed directions and speed reduction gear means interposed between said drive means and said rack to transmit driving energy therebetween.

21. A mechanism according to claim 20 wherein said rack member is driven between two opposed ends of a path of travel and wherein said operating member is arranged to be brought into abutment with said rack to be driven in either one of two opposite directions when said rack reaches either of said two opposed ends of said path of travel.

22. A mechanism according to claim 20 wherein said rack member comprises a toothed configuration and wherein said speed reduction gear means comprise a worm gear in driving engagement with said toothed configuration.

23. A mechanism according to claims 1 or 2 wherein said energy storage means comprise an inertial mass.

24. A mechanism according to claims 1 or 2 wherein said drive means comprise an electric motor including a timing unit adapted to de-energize said electric motor before said output member has moved completely through a path of movement through which it is driven by said drive means and said energy storage means.

25. A mechanism according to claim 23 wherein said inertial mass has a mass which is constant during its acceleration.

26. A door closing mechanism comprising: drive means; energy storage means connected to receive energy from said drive means; actuating means for effecting interconnecting engagement between door means and portal means to be closed by said door means; and output means for transmitting to said actuating means energy from said drive means and said energy storage means to impart through said actuating means a relative force driving said door means toward a closed position; said output means and said actuating means being arranged to delay transmission of energy from said output means to said actuating means until said drive means has undergone a number of revolutions and to effect commencement of transmission of energy from said output means to said actuation means independently of the angular velocity of said drive means when said drive means has undergone said number of revolutions.

27. In a vehicle including door means and portal means to be closed by said door means, the improvement of a door closing mechanism comprising: drive means; energy storage means connected to receive energy from said drive means; actuating means for effecting interconnection between said door means and said portal means; and output means for transmitting to said actuating means energy from said drive means and said energy storage means in order to impart through said actuating means a relative force between said door means and said portal means to drive said door means toward a closed position; said output means and said actuating means being arranged to delay transmission of said energy therebetween until said drive means has undergone a number of revolutions during which said drive means operates to impart energy to said energy storage means for storage therein; said output means and said actuating means also being arranged to effect commencement of transmission of energy from said output means to said actuating means independently of the angular velocity of said drive means when said drive means has undergone said number of revolutions, the energy thus transmitted including energy previously stored in said energy means from said drive means.

28. A mechanism according to claims 1, 2, 26 or 27 wherein said energy storage means comprises a flywheel driven by said drive means.

29. A drive mechanism comprising drive means, energy storage means connected to receive energy from said drive means, an output member for transmitting energy from said drive mechanism, and transmission means for transmitting driving energy to said output member from both said drive means and said energy storage means, said transmission means being arranged to delay transmission of energy to said output member until said drive means has undergone a designated number of revolutions and to effect commencement of transmission of driving energy to said output member when said drive means has undergone said designated number of revolutions.

30. A door closing mechanism comprising drive means, energy storage means connected to receive energy from said drive means, actuating means for effecting interconnecting engagement between door means and portal means to be closed by said door means, and output means for transmitting to said actuating means energy from said drive means and said energy storage means to impart through said actuating means a relative force driving said door means toward a closed position, said output means and said actuating means being arranged to delay transmission of energy from said output means to said actuating means until said drive means has undergone a designated number of revolutions and to effect commencement of transmission of energy from said output means to said actuating means when said drive means has undergone said designated number of revolutions.

31. A mechanism according to claim 30 wherein said actuating means include a crank arm having a pin, and wherein said output means comprise a slotted arm having a slot defined therein, with said pin being engaged within said slot, said delay of energy transmission occurring as a result of movement of said pin within said slot during which no energy is transmitted from said output means to said actuating means.

32. A mechanism according to claim 27 further including energizing means including switch means for controlling energization of said drive means in response to a sudden change in the velocity of said vehicle.

* * * * *

UNITED STATES PATENT OFFICE

CERTIFICATE OF CORRECTION

Patent No. 4,269,440 Dated May 26, 1981

Inventor(s) Egon Gelhard

It is certified that error appears in the above-identified patent and that said Letters Patent are hereby corrected as shown below:

In the heading of the patent [30] should read as follows:

[30] Foreign Application Priority Data

| | | |
|---|---|---|
| November 8, 1975 | Germany | 25 50 213 |
| November 10, 1975 | Germany | 25 50 409 |
| December 22, 1975 | Germany | 25 57 970 |

Signed and Sealed this

*Thirteenth* Day of *October 1981*

[SEAL]

*Attest:*

GERALD J. MOSSINGHOFF

*Attesting Officer*

*Commissioner of Patents and Trademarks*